US009771244B2

(12) United States Patent
Lehtinen et al.

(10) Patent No.: US 9,771,244 B2
(45) Date of Patent: Sep. 26, 2017

(54) ELEVATOR

(71) Applicants: Hannu Lehtinen, Numminen (FI); Riku Lampinen, Helsinki (FI); Markku Anttila, Lohja (FI); Gabriel Ciuculescu, Vantaa (FI); Markus Salmi, Vantaa (FI); Mikko Puranen, Riihimaki (FI)

(72) Inventors: Hannu Lehtinen, Numminen (FI); Riku Lampinen, Helsinki (FI); Markku Anttila, Lohja (FI); Gabriel Ciuculescu, Vantaa (FI); Markus Salmi, Vantaa (FI); Mikko Puranen, Riihimaki (FI)

(73) Assignee: Kone Corporation, Helsinki (FI)

( * ) Notice: Subject to any disclaimer, the term of this patent is extended or adjusted under 35 U.S.C. 154(b) by 15 days.

(21) Appl. No.: 14/712,482

(22) Filed: May 14, 2015

(65) Prior Publication Data

US 2015/0329319 A1 Nov. 19, 2015

(30) Foreign Application Priority Data

May 19, 2014 (EP) ..... 14168760

(51) Int. Cl.

| | |
|---|---|
| ***B66B 7/12*** | (2006.01) |
| ***B66B 5/02*** | (2006.01) |
| ***B66B 5/00*** | (2006.01) |

(52) U.S. Cl.

CPC ..... *B66B 7/1215* (2013.01); *B66B 5/0031* (2013.01); *B66B 5/022* (2013.01)

(58) Field of Classification Search

CPC ..... B66B 5/0031; B66B 5/0037; B66B 5/022; B66B 5/024; B66B 7/1215

See application file for complete search history.

(56) References Cited

U.S. PATENT DOCUMENTS 4,995,855 A * 2/1991 Hasebe ..... F16H 55/38 474/167
5,578,801 A * 11/1996 Hofmann ..... B66B 1/28 187/287

(Continued)

FOREIGN PATENT DOCUMENTS

CA 2547002 A1 * 12/2005 ..... B66B 5/0037
CH WO 2014001371 A1 * 1/2014 ..... B66B 5/0031

(Continued)

OTHER PUBLICATIONS

EPO, Machine Translation, WO 2014 001 371 A1, pp. 1-7.*
European Search Report for EP14168760 dated Nov. 4, 2014.

*Primary Examiner* — William A Rivera
*Assistant Examiner* — Stefan Kruer
(74) *Attorney, Agent, or Firm* — Harness, Dickey & Pierce P.L.C.

(57) ABSTRACT

The invention relates to an elevator comprising
- a hoistway;
- an elevator car vertically movable in the hoistway;
- a plurality of ropes connected to the car;
- a rotatable traction member comprising a circumferential traction surface area for each of the several ropes;
- each rope being arranged to pass around the rotatable traction member resting against a circumferential traction surface area of the traction member;
- drive machinery for controlling rotation of the rotatable traction member.

The elevator comprises means for detecting displacement of each of the ropes over a first limit position of the rope in the first axial direction of the rotatable traction member, and over a second limit position of the rope in the second axial direction of the traction member; and in that
- displacement of one or more of said ropes in axial direction of the rotatable traction member over the first (Continued)

or second limit position is arranged to trigger the drive machinery to stop the rotation of the rotatable traction member.

13 Claims, 4 Drawing Sheets

(56) References Cited

U.S. PATENT DOCUMENTS 6,267,205 B1 * 7/2001 Piech ..... B66B 7/062 187/292
6,742,769 B2 * 6/2004 Baranda ..... F16H 55/50 254/390
2002/0100902 A1 * 8/2002 Strbuncelj ..... B66B 11/043 254/266
2004/0256180 A1 12/2004 Eichhorn et al.
2007/0062762 A1 * 3/2007 Ach ..... B66B 7/062 187/266
2008/0223665 A1 * 9/2008 O'Donnell ..... B66B 7/062 187/256
2008/0289912 A1 * 11/2008 Perron ..... B66B 15/04 187/411
2010/0259253 A1 * 10/2010 Nishiyori ..... B66B 7/123 324/240
2011/0315489 A1 12/2011 Nakamori
2013/0292211 A1 * 11/2013 Polak ..... B66B 15/04 187/254
2014/0202797 A1 7/2014 Lenk
2016/0340150 A1 * 11/2016 Helenius ..... B66B 5/00

FOREIGN PATENT DOCUMENTS

EP 2396264 A1 12/2011
EP 2574583 A1 4/2013
FI EP 2987758 A1 * 2/2016 ..... B66B 7/1215
WO WO 2010002410 A1 * 1/2010 ..... B66B 15/04

* cited by examiner

ELEVATOR

This application claims priority to European Patent Application No. EP14168760 filed on May 19, 2015, the entire contents of which are incorporated herein by reference.

FIELD OF THE INVENTION

The invention relates to an elevator. The elevator is particularly meant for transporting passengers and/or goods.

BACKGROUND OF THE INVENTION

An elevator typically comprises a hoistway, and an elevator car and a counterweight movable in the hoistway. The elevator further comprises a rotatable traction member, such as a traction wheel, engaging ropes connected to the car. The ropes pass around the rotatable traction member and suspend at least the elevator car and the counterweight. For controlling rotation of the rotatable traction member, the elevator comprises a drive machinery, which typically comprises a motor for rotating the rotatable traction member, a control unit for controlling the motor, as well as a brake for braking rotation of said rotatable traction member. Force for moving the car and counterweight is transmitted from the motor to the car via the rotatable traction member and the roping, whereby car movement can be controlled by controlling rotation of the rotatable traction member. The elevator comprises plurality of landings at which the elevator car is arranged to stop during use of the elevator for loading and/or unloading of the car.

In an elevator having traditional steel ropes, the ropes pass inside grooves of the rotatable traction member. In this kind of elevator the rope shape keep the tensioned ropes in their grooves. There are, however, elevators where the ropes cannot be reliably and gently guided by such grooves. This kind of challenges are mostly faced with belt like ropes. Particularly, "groove" type guidance, which includes considerable edges, cannot be used with ropes having sensitive surface structure and/or internal structure.

Running of a rope outside its intended course is potential to cause different dangerous problems such as damaging the rope itself or other components of the elevator. Thus, there is a need to prevent the rope from running outside its intended course, or in some other way prevent the situation from developing this far. This is challenging especially with solutions where the guidance by the rotatable traction member is not strong, such as with solutions where belt-like ropes are guided by cambered circumference of the rotatable traction member.

In solutions utilizing cambered (cambered shape also later referred to as crowning shape) traction member, it may happen that the rope reaches the shallow edge area between adjacent crowning shapes meant to guide adjacent ropes. Crowning acts as guidance of the rope and generally the total width of the crowning is the area where rope can move sideways. The intended placement of the rope is in the middle of the cambered area; but normally the rope is allowed to move sideways a little bit. Once a rope meets the shallow edge area it will try to climb along the cambered shape meant for the rope next to this rope. This is dangerous, firstly because the edge area will potentially damage the individual rope, but also because the rope configuration has changed away from how it is meant to be, which could cause dramatic system level problems.

A drawback of the known elevators has been that running of a rope outside its intended course, and further development of the problem into even more hazardous state have not been prevented in an adequately reliable manner. This has been a problem especially with elevators where mechanical shape-locking of the rope into its groove has been unreliable or impossible due to specific configuration of the ropes and the traction member.

BRIEF DESCRIPTION OF THE INVENTION

The object of the invention is, inter alia, to solve previously described drawbacks of known solutions and problems discussed later in the description of the invention. The object of the invention is to introduce a new elevator wherein running of a rope of an elevator outside its intended course is reacted to quickly and effectively. Embodiments are presented, inter alia, in which further development of the problem into even more hazardous state can be prevented in a reliable manner. Embodiments are presented, inter alia, in which said object is realized with simple and reliable configuration. Embodiments are presented, inter alia, where this object is achieved gently without damaging the ropes.

It is brought forward a new elevator, which comprises a hoistway, an elevator car vertically movable in the hoistway, a plurality of ropes connected to the car, a rotatable traction member, preferably located in or in proximity of the upper end of the hoistway, the rotatable traction member comprising a circumferential traction surface area for each of the several ropes, each rope being arranged to pass around the rotatable traction member resting against a circumferential traction surface area of the traction member. The elevator further comprises a drive machinery for controlling rotation of the rotatable traction member. The elevator further comprises means for detecting displacement of each of the ropes over a first limit position (defined for the rope in question) in the first axial direction of the rotatable traction member, and over a second limit position (defined for the rope in question) in the second axial direction of the traction member, in particular for detecting displacement of each of the ropes away from between a first limit position and a second limit position, which first and second limit positions are apart from each other in axial direction of the rotatable traction member. Displacement of one or more of said ropes in axial direction of the rotatable traction member over the first or second limit position (defined for the rope in question) is arranged to trigger the drive machinery to stop the rotation of the rotatable traction member, preferably to brake rotation of the rotatable drive member with mechanical brake(s) of the elevator and/or to stop the motor from rotating the rotatable traction member. Said limits thus define the allowed range of movement of the rope in question in direction of said axis. Thus, drifting of the rope away from its intended course, particularly from its circumferential traction surface area can be reacted to by bringing the elevator into a swift stop.

In a preferred embodiment, the ropes are in the form of belts. Belt-shaped ropes are prone to wandering in axial direction of the rotatable traction member, because they are difficult to control without damaging the rope and without complicated arrangements. The solution presented is particularly preferable in case each circumferential traction surface area of the rotatable traction member has a crowning shape.

In a preferred embodiment, the elevator comprises a safety circuit breaking of which is arranged to cause the drive machinery to brake rotation of the traction member and/or to stop rotating the rotatable traction member, and displacement of one or more of said ropes in axial direction of the traction member over the first or second limit position is arranged to trigger said stopping i.e. the drive machinery to brake rotation of the rotatable traction member and/or to stop rotating the rotatable traction member by triggering a series of one or more actions including at least breaking of the safety circuit. In this way, the reaction to displacement of the rope(s) is swift and safe. Preferably said means for detecting displacement of each of the ropes preferably comprise a relay operating a safety switch of the safety circuit.

In a preferred embodiment, said means for detecting displacement of each of said ropes comprise on opposite sides of each of said ropes in said axial direction of the traction member a first and a second sensing member, the first sensing member being positioned at the first limit position defined for the rope in question, particularly such that a contact face thereof is positioned at the point of the limit position, and the second sensing member being positioned at the second limit position defined for the rope in question, particularly such that a contact face thereof is positioned at the point of the limit position, each sensing member being displaceable, in particular by the rope, preferably pushed by it, which rope has displaced in said axial direction to collide into contact with the sensing member, displacement of each sensing member being arranged to trigger said stopping i.e. the drive machinery stop the rotation of the traction member.

In a preferred embodiment, each of said sensing members is displaceable at least in the longitudinal direction of the rope, whereby the rope, when it moves in its longitudinal direction during elevator use and is displaced in said axial direction to collide into contact with the sensing member, is arranged to engage the sensing member, preferably frictionally, and push, and thereby displace it at least in the longitudinal direction of the rope. Thus, when the rope has engaged with a sensing member next to it, the rope can displace the sensing member in question by its movement. The sensing member in question moves then along with the rope after said engagement, whereby chafing between the rope and the sensing member engaging it, is not extensive enough to cause damage to the rope.

In a preferred embodiment, each of said sensing members is mounted pivotally displaceably around an axis parallel with the axial direction of the traction member, pivoting displacement of each sensing member being arranged to trigger said stopping i.e. the drive machinery to stop the rotation of the traction member. The displacement in the longitudinal direction of the rope mentioned in the previous paragraph is preferably arranged to displace the sensing member by pivoting around said axis.

In a preferred embodiment, said sensing members are mounted displaceably via a common displaceable carrier body. The sensing members together with the body preferably form a rake-like structure. The sensing members are thus simple to position relative to ropes in such a way there are for each rope on opposite sides of the rope in said axial direction of the traction member a first and a second sensing member.

In a preferred embodiment, said means for detecting displacement of each of said ropes comprise at least one electrical sensor arranged to sense position of the displaceable carrier body. Displacement of the carrier body, in particular pivoting thereof, is arranged to trigger said stopping i.e. the drive machinery to stop the rotation of the traction member. Thus, displacement of each sensing member is arranged to cause displacement of the carrier body, the displacement of which is arranged to trigger said stopping i.e. the drive machinery stop the rotation of the traction member. Thus displacement of each sensing member is arranged to trigger said stopping via said carrier body.

In a preferred embodiment, said circumferential traction surface areas have each a surface roughness or a surface texture substantially different from the roughness or a surface texture, respectively, of the circumferential surface areas of the traction member next to it in said axial direction of the traction member, whereby drifting of the rope away from its circumferential traction surface area to rest against the surface area next to it changes sound and/or vibration produced in the contact area during use, and said means for detecting displacement of one or more of said ropes comprise a sensing arrangement comprising one or more sensors for sensing sound and/or a vibration, which sensing arrangement is arranged to trigger said stopping i.e. the drive machinery to stop the rotation of the traction member if the sound and/or vibration sensed by the sensing arrangement meet predetermined criteria, such as reaches a predetermined limit or changes in a predetermined way. Thus, the displacement of rope(s) can be reacted to effectively with a simple and reliable configuration. Also, this can be carried out gently without damaging the ropes. Preferably, said circumferential traction surface areas are each smoother, such as have a surface roughness lower, or a more even surface texture, than the circumferential surface areas of the traction member next to it in said axial direction of the traction member. In this case, said circumferential surface areas of the traction member next to said circumferential traction surface areas preferably have each a serrated texture. Said circumferential traction surface areas are then preferably unserrated.

In a preferred embodiment, said means for detecting displacement of one or more of said ropes comprise one or more sensing devices for receiving ultrasonic sound or electromagnetic radiation from said limit positions and a monitoring unit connected to the one or more sensing devices and arranged to trigger said stopping i.e. the drive machinery to stop the rotation of the traction member, if ultrasonic sound or electromagnetic radiation received from one or more of said limit positions meets predetermined criteria, such as reaches a predetermined limit or changes in a predetermined way. Thus, the displacement of rope(s) can be reacted to effectively with a simple and reliable configuration. Also, this can be carried out gently without damaging the ropes. Preferably, each of said one or more sensing devices comprise a receiver for receiving ultrasonic sound, or electromagnetic radiation from the limit position(s) it is associated with. Also preferably, said means for detecting displacement of each of said ropes comprise one or more senders for sending towards said limit positions. Then, it is preferable that each of the one or more sensing devices comprises a sender for sending ultrasonic sound or electromagnetic radiation towards the limit position(s) it is associated with.

The one or more sensing devices mentioned in previous paragraphs can comprise one or more photocells, one or more laser beam sensors, one or more ultrasonic sensing devices, one or more optical cameras, one or more scanners, one or more machine vision devices, or one or more pattern recognition devices.

In a preferred embodiment, the ropes pass around the rotatable traction member adjacent each other in axial direction of the rotatable traction member as well as adjacent each other in the width-direction of the ropes, the wide sides of the ropes against the traction member.

In a preferred embodiment, the rotatable traction member is a traction wheel.

In a preferred embodiment, each circumferential traction surface area of the rotatable traction member has an individual crowning shape.

In a preferred embodiment, the drive machinery for controlling rotation of the rotatable traction member comprises a motor for rotating the rotatable traction member, and a control unit for controlling the motor, and/or a brake for braking rotation of said rotatable traction member.

In a preferred embodiment, displacement of one or more of said ropes in axial direction of the traction member over the first or second limit position is arranged to trigger said stopping i.e. drive machinery to stop the rotation of the traction member including braking rotation of the rotatable drive member with mechanical brake(s) of the elevator and/or stopping the motor from rotating the rotatable traction member. Said braking rotation of the rotatable drive member includes preferably at least activating the mechanical brake(s). In addition to said stopping the motor from rotating the rotatable traction member the motor can be additionally electrically controlled to decelerate the rotation of the rotatable traction member.

In a preferred embodiment, when the rope is completely between the first and second limit thereof, its rope surface area placed against the traction member and the circumferential traction surface area (meant for the rope in question) at least substantially coincide.

In a preferred embodiment, the ropes are in the form of belts having width/thickness ratio at least 2. The in the form of belts preferably have an elastic coating embedding load bearing members of the rope, which load bearing members are positioned on the same plane adjacent each other in width direction of the rope, and isolated by said coating. The elastic coating increases friction between the rotatable traction member and the rope, but also protects the load bearing members. The load bearing members are preferably metallic, such as steel wires, or non-metallic members, such as members made of fiber-reinforced composite material, extending throughout the length of the rope.

In a preferred embodiment, said means for detecting displacement of each of the ropes are arranged to detect displacement of a rope section of each rope, which rope section is positioned against the traction wheel, or which rope section is positioned in the proximity of the traction wheel, preferably less than 2 meters from the traction wheel.

The elevator as described referred to above is preferably, but not necessarily, installed inside a building. The car of the elevator is preferably arranged to serve two or more landings. It preferably responds to calls from landing(s) and/or destination commands from inside the car so as to serve persons on the landing(s) and/or inside the elevator car. Preferably, the car has an interior space suitable for receiving a passenger or passengers.

BRIEF DESCRIPTION OF THE DRAWINGS

In the following, the present invention will be described in more detail by way of example and with reference to the attached drawings, in which.

DETAILED DESCRIPTION

Figure 1A:
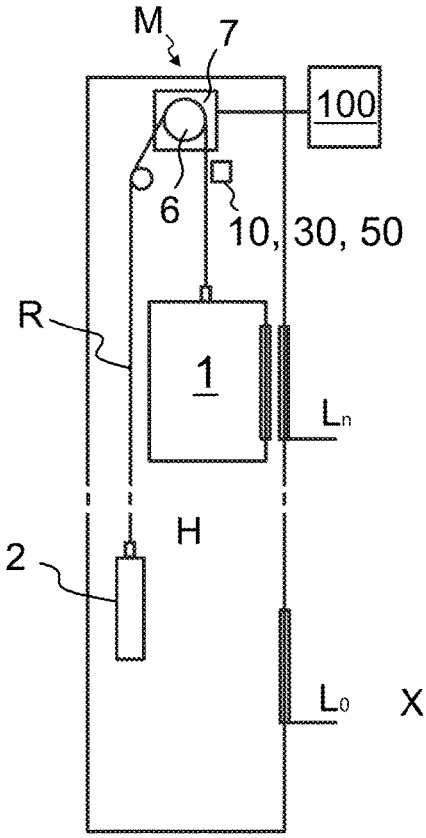
FIG. 1*a* illustrates schematically an elevator according to an embodiment of the invention.
Figure 1B:
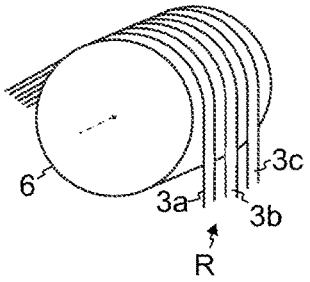
FIGS. 1*b* and 1*c* illustrate details for the elevator of FIG. 1*a*.

FIG. 1*a* illustrates an elevator according to a preferred embodiment. The elevator comprises a hoistway H, an elevator car 1 and a counterweight 2 vertically movable in the hoistway H. The elevator further comprises a rotatable traction member 6, in particular a traction wheel located in or at least in proximity of the upper end of the hoistway H. The rotatable traction member 6 engages an elevator roping R, comprising several ropes, which are connected to the car 1 and pass adjacent each other around the rotatable traction member 6. The roping R suspends the elevator car 1, and in this case, also a counterweight 2. The elevator comprises a drive machinery M for controlling rotation of the rotatable traction member 6, which drive machinery M comprises a motor 7 for rotating the rotatable traction member 6, and a control unit 100 for controlling the motor 7 and a brake b for braking rotation of said rotatable traction member 6. Force for moving the car 1 and counterweight 2 is transmitted from the motor 7 to the car 1 via the rotatable traction member 6 and the roping R, whereby car movement can be controlled by controlling rotation of the rotatable traction member 6. The elevator comprises plurality of landings $L_0$ to $L_n$, at which the elevator car 1 is arranged to stop during use of the elevator.

Figure 1C:
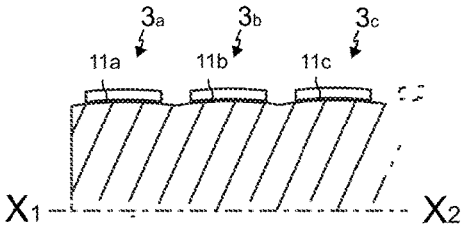

The rotatable traction member 6 has a circumferential traction surface area 11*a*,11*b*,11*c* for each of the several ropes 3*a*, 3*b*, 3*c*, i.e. a specific area individually for each rope against which the rope in question is intended to pass. As illustrated in FIG. 1*c*, each of said ropes 3*a*,3*b*,3*c* is arranged to pass around the rotatable traction member 6 resting against the circumferential traction surface area 11*a*,11*b*,11*c* of the traction member 6 provided for it.

The elevator comprises means (10,12*a*-13*c*; 30; 50) for detecting displacement of each of the ropes 3*a*,3*b*,3*c* in axial direction of the rotatable traction member (6). Said means are provided for detecting displacement of each of the ropes 3*a*,3*b*,3*c* away from between a first limit L1*a*,L1*b*,L1*c* position and a second limit position L2*a*,L2*b*,L2*c*, which first and second limit positions L1*a*, L2*a*; L1*b*, L2*b*; L1*c*,L2*c* are apart from each other in axial direction of the traction member 6. More specifically, said means (10,12*a*-13*c*; 30; 50) are provided for detecting displacement of each of the ropes 3*a*,3*b*,3*c* over a first limit position L1*a*,L1*b*,L1*c* defined for the rope in question in the first axial direction $X_1$ of the rotatable traction member 6, and over a second limit position L2*a*,L2*b*,L2*c* defined for the rope in question in the opposite direction, i.e. the second axial direction $X_2$ of the traction member 6, which limit positions are on opposite sides of the rope 3*a*,3*b*,3*c* in question in axial direction of the rotatable traction member 6. Displacement of one or more of said ropes 3*a*,3*b*,3*c* away from between the first limit position L1*a*,L1*b*,L1*c* and the second limit position L2*a*, L2*b*,L2*c* in the axial direction of the traction member 6, i.e. in the first or second axial direction over the first or the second limit position L1*a*, L2*a*; L1*b*, L2*b*; L1*c*,L2*c* respectively is arranged to trigger said stopping, i.e. said drive machinery M to stop the rotation of the traction member 6, preferably to brake rotation of the rotatable traction member 6 by activating mechanical brakes b and/or to stop the motor from rotating the rotatable traction member 6. Thereby said limit positions define the allowed range of movement of the rope 3*a*,3*b*,3*c* in question in direction of said axis. Upon displacement of a rope 3*a*,3*b*,3*c* away from its range of movement, stopping of the rotation of the traction member is triggered. The limits positions L1*a*, L2*a*; L1*b*, L2*b*; L1*c*,L2*c* are preferably such that when the rope 3*a*,3*b*,3*c* in question is completely between the first and second limit position L1*a*, L2*a*; L1*b*, L2*b*; L1*c*,L2*c* thereof, its rope surface area placed against the traction member 6 and the circumferential traction surface area 11*a*,11*b*,11*c* meant for the rope in question at least substantially coincide. Drifting of the rope 3*a*,3*b*,3*c* away from its circumferential traction surface area 11*a*,11*b*,11*c* is thus reacted to by bringing the elevator into a swift stop.

The ropes are in the illustrated embodiments in the form of belts as illustrated in FIG. 1*c*, for instance. Belt-shaped ropes are prone to wandering in axial direction of the rotatable traction member 6, because they are difficult to control without damaging the rope and without complicated arrangements. The solution presented is particularly preferable in case each circumferential traction surface area 11*a*, 11*b*,11*c* of the rotatable traction member 6 has an individual crowning shape for preventing movement of the rope placed to pass against it from moving away from its circumferential traction surface area 11*a*,11*b*,11*c* in axial direction of the rotatable traction member 6.

Figure 2:
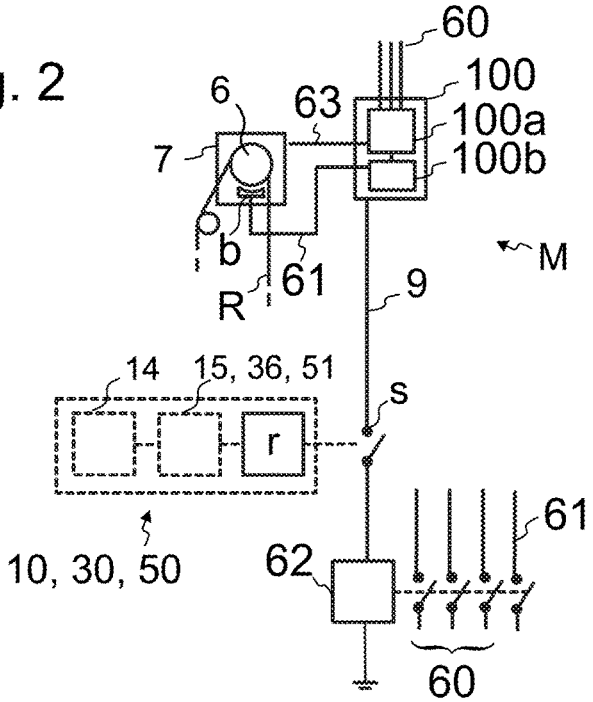
FIG. 2 illustrates a preferred arrangement for triggering the drive machinery of the elevator of FIG. 1*a* to stop the rotation of the rotatable traction member.

FIG. 2 shows a preferred arrangement for triggering of said stopping i.e. the triggering of the drive machinery M to stop the rotation of the rotatable traction member 6 in a swift and reliable manner. In this case, the elevator comprises a safety circuit 9 (also referred to as a safety chain) breaking of which is arranged to cause the drive machinery M to brake rotation of the traction member 6 (with brake(s) b of the elevator) and to stop the motor from rotating the rotatable traction member 6, and displacement of one or more of said rope 3*a*,3*b*,3*c* in axial direction of the traction member 6 over the first or second limit position is arranged to trigger said stopping i.e. the drive machinery M to brake rotation of the rotatable traction member 6 and to stop rotating the rotatable traction member 6 by triggering a series of one or more actions including at least breaking of said safety circuit 9.

It is preferable, that the breaking of the safety circuit 9 causes that power supply 60 to the frequency converter 100*a* is broken (the power supply 60 being thereby also a power supply of the motor 7) and/or that the power supply 61 of the actuator(s) of the brake(s) b is broken, which actuator(s) keep(s) the brake(s) b normally in released state when powered. For this purpose the safety circuit 9 is connected to a contactor 62, which may be in the form of a relay, controlling switches of the power supply lines 60 and 61, as illustrated in the FIG. 2. Preferably, the safety circuit 9 is under voltage and the breaking thereof is arranged to cause the contactor 62 to release said switches to opened state and thereby to break the power supply of these power lines 60,61. For the purpose of breaking the safety circuit 9 in context of said triggering, said means (10,12*a*-13*c*; 30; 50) preferably comprise a relay r operating a safety switch s of the safety circuit 9. The relay r is preferably a normally closed-type relay (NC), for instance relay in the form of a SPSTNC-type relay. The safety circuit 9 may be seen to form part of the drive machinery M.

As mentioned, the drive machinery comprises an elevator control unit 100, This elevator control unit 100 preferably comprises a frequency converter 100*a* and a monitoring unit 100*b*. The control unit 100 is preferably connected with electrical connections 61,63 to the brake(s) b and the motor 7 via which connections it can control the brake(s) b and the motor 7. Thus, in context of said triggering the actions can be realized via these connections. Said electrical connection 63 is preferably electrical power supply for the motor 7 and said electrical connection 61 is preferably electrical power supply for the brake(s) b. The brake(s) are preferably mechanical brake(s). The brake(s) is/are preferably arranged to act on the drive member 6 during the braking by frictional engagement either directly or via a component connected to rotate with the drive member 6. The brake(s) is/are preferably so called machine brake(s). The brake b and the motor 7 are preferably both operable by said control unit 100.

Figure 3:
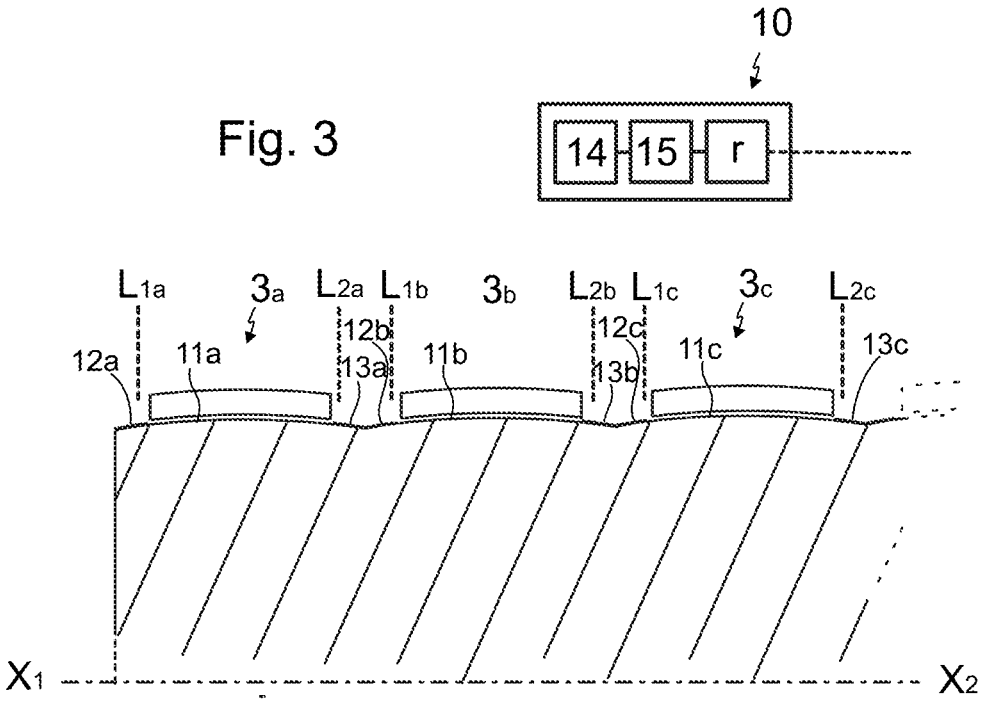
FIG. 3 illustrates a first preferred embodiment for the means for detecting displacement of the ropes of the elevator in axial direction of the rotatable traction member.
Figure 4:
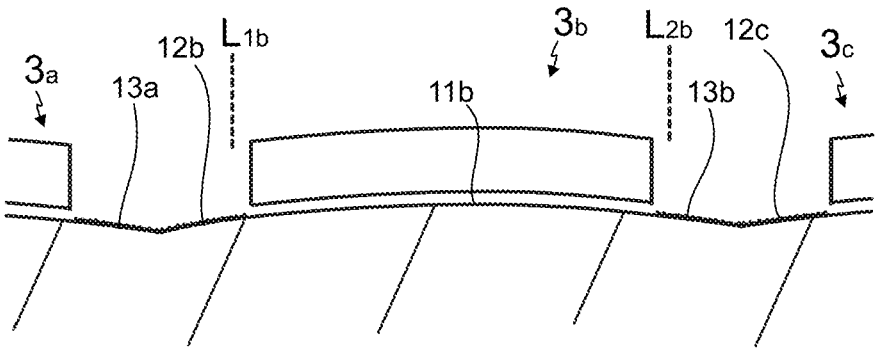
FIG. 4 illustrates a partial and enlarged view of FIG. 3.

FIG. 3 illustrates a preferred first embodiment for the means 10,12*a*-13*c* for detecting the above mentioned displacement of each of the ropes 3*a*,3*b*,3*c* in axial direction of the rotatable traction member 6. As mentioned, the rotatable traction member 6 comprises a circumferential traction surface area for each of the several ropes 3*a*, 3*b*, 3*c* and each rope 3*a*,3*b*,3*c* is arranged to pass around the rotatable traction member 6 resting against a circumferential traction surface area 11*a*,11*b*,11*c* of the traction member 6. In the preferred embodiment these circumferential traction surface areas 11*a*,11*b*,11*c* have each a surface roughness or a surface texture substantially different than the circumferential surface areas 12*a*,13*a*;12*b*,13*b*,12*c*,13*c* of the traction member 6 next to it in said axial direction of the traction member 6, whereby drifting of the rope 3*a*,3*b*,3*c* away from its circumferential traction surface area 11*a*,11*b*,11*c* to rest against the surface area 12*a*,13*a*;12*b*,13*b*,12*c*,13*c* next to it changes sound and/or vibration produced in the contact area during passage of the ropes against the rotatable traction member 6. Said means 10,12*a*-13*c* for detecting displacement of one or more of said ropes 3*a*,3*b*,3*c* comprise a sensing arrangement 14,15 comprising one or more sensors 14 for sensing sound and/or a vibration, which sensing arrangement 14,15 is arranged to trigger said stopping i.e. to trigger the drive machinery M to stop the rotation of the traction member 6, if the sound and/or vibration sensed by the sensing arrangement 14,15 meet(s) predetermined criteria, such as reaches a predetermined limit or changes in a predetermined way. For determining whether the sound and/or vibration sensed by the sensing arrangement 14,15 meet(s) predetermined criteria the sensing arrangement 14,15 preferably comprises a processing unit 15 arranged to carry out said determination and said triggering to stop the rotation of the rotatable traction member 6 if the predetermined criteria is/are met.

In this embodiment the position of each of the limit position L1*a*, L2*a*; L1*b*, L2*b*; L1*c*,L2*c* is defined by said criteria, in particular such that each limit position is in the position that the rope has reached when the criteria are met. The criteria are preset such that the sound and/or vibration meet(s) the predetermined criteria, such as reaches a predetermined limit or changes in a predetermined way, when the rope has drifted axially to be positioned to a certain amount against the circumferential surface 12*a*,13*a*;12*b*,13*b*,12*c*, 13*c* of the traction member 6 having different surface roughness than the circumferential traction surface area 11*a*,11*b*,11*c* of the rope in question. In practice, the criteria are preset such that for each rope the first limit position L1*a*, L1*b*, L1*c* is located within the axial length of the circumferential surface 12*a*;12*b*,12*c* of the traction member next to the circumferential traction surface area 11*a*,11*b*,11*c* on the first axial side thereof, and that for each rope 3*a*,3*b*,3*c* the second limit position L2*a*, L2*b*, L2*c* is located within the axial length of the circumferential surface 13*a*;13*b*,13*c* of the traction member 6 next to the circumferential traction surface area 11*a*,11*b*,11*c* on the second axial side thereof.

In the preferred embodiment, the circumferential traction surface areas 11*a*,11*b*,11*c* are each smoother, such as have a surface roughness lower or more even surface texture, than the circumferential surface areas 12*a*,13*a*;12*b*,13*b*,12*c*,13*c* of the rotatable traction member 6 next to it in said axial direction of the traction member 6, whereby drifting of the rope 3*a*,3*b*,3*c* away from its circumferential traction surface area 11*a*,11*b*,11*c* to rest against the circumferential surface area 12*a*,13*a*;12*b*,13*b*,12*c*,13*c* of the traction member 6 next to it on either axial side thereof, increases sound and/or vibration produced in the contact area during passage of the rope against the rotatable traction member 6.

As mentioned, the circumferential traction surface areas 11*a*,11*b*,11*c* can each be smoother than the circumferential surface areas 12*a*,13*a*;12*b*,13*b*,12*c*,13*c* of the rotatable traction member 6 next to it in said axial direction of the traction member 6 by having a more even surface texture than the latter. For this purpose, said circumferential surface areas of the traction member next to said circumferential traction surface areas preferably have each an uneven texture, such as a pattern machined into the surface of the traction member 6. Said uneven texture is preferably a serrated texture machined into the surface of the traction member 6. Said circumferential traction surface areas are then preferably unserrated.

Figure 5:
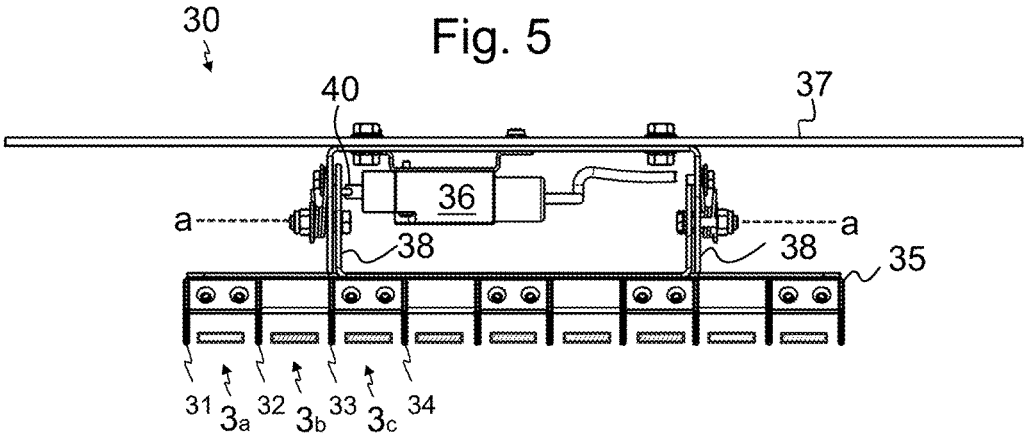
FIG. 5 illustrates a second preferred embodiment for the means for detecting displacement of the ropes of the elevator in axial direction of the rotatable traction member.
Figure 6:
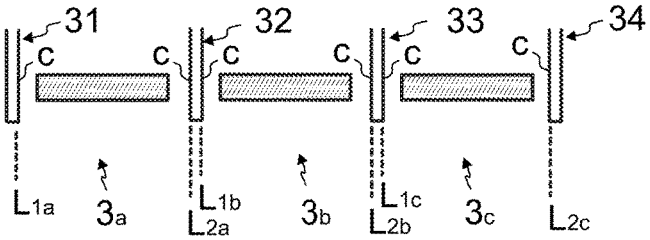
FIG. 6 illustrates a partial and enlarged view of FIG. 5.
Figure 7:
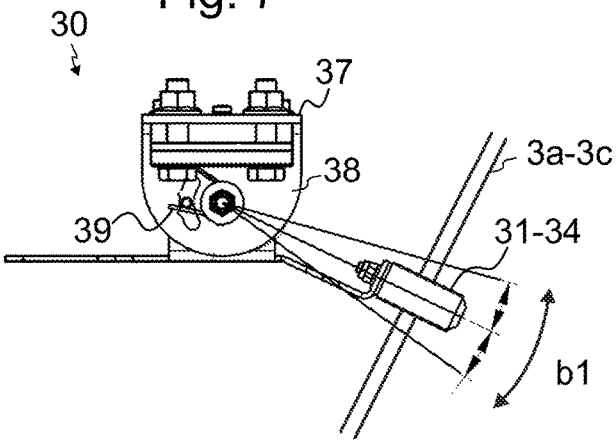
FIG. 7 illustrates the means for detecting displacement of the ropes of FIG. 5 as viewed in said axial direction.

FIG. 5 illustrates a preferred second embodiment for the means for detecting the above mentioned displacement of each of the ropes 3*a*,3*b*,3*c* in axial direction of the rotatable traction member 6. Said means 30 comprise for each rope on opposite sides of the rope 3*a*,3*b*,3*c* in said axial direction of the traction member 6 a first and a second sensing member 31,32; 32, 33; 33,34. In the embodiment as illustrated, there are several ropes whereby there are sensing members which extend between the ropes next to each other. Each sensing member comprises a contact face which the rope next to it can contact when the rope in question is displaced in said axial direction. Each first sensing member 31,32,33 is positioned at the first limit position L1*a*,L1*b*,L1*c* of the rope in question, such that a contact face c thereof is positioned at the point of the limit position L1*a*,L1*b*,L1*c*. Each second sensing member 32,33,34 is positioned correspondingly at the second limit position L2*a*,L2*b*,L2*c* of the rope in question such that a contact face c thereof is positioned at the point of the limit position, and each sensing member 31,32; 32, 33; 33,34 is arranged to be displaceable pushed by the rope, which is displaced in said axial direction such that it collides into contact with the sensing member in question. Displacement of each sensing member 31,32,33,34 is arranged to trigger said stopping i.e. to trigger the drive machinery M to stop the rotation of the traction member 6. FIG. 6 illustrates a partial and enlarged view of FIG. 5. For the sake of clarity, only a small number of the sensing members are marked with reference numbers and illustrated in FIG. 6. The rest of the sensing members visible in FIG. 5 works similarly as the ones discussed here.

Each of said sensing members 31,32,33,34 is displaceable at least in the longitudinal direction of the rope 3*a*,3*b*,3*c*, whereby the rope 3*a*,3*b*,3*c*, when it moves in its longitudinal direction during elevator use, in particular during car movement, and is displaced in said axial direction to collide into contact with the sensing member 31,32,33,34, is arranged to engage the sensing member 31,32,33,34 next to it and push it at least in the longitudinal direction of the rope 3*a*,3*b*,3*c*. Thus, when the rope 3*a*,3*b*,3*c* has engaged with a sensing member 31,32,33 or 34 next to it, the rope 3*a*,3*b*,3*c* can displace the sensing member 31,32,33,34 in question by its movement. The sensing member 31,32,33 or 34 in question moves then along with the rope 3*a*,3*b*,3*c* after said engagement, whereby chafing between the rope 3*a*,3*b*,3*c* and the sensing member 31,32,33 or 34 engaging it, is not extensive enough to cause damage to the rope 3*a*,3*b*,3*c*. Said engagement is preferably frictional. The contact surface c of each sensing member 31,32,33,34 is preferably elastically displaceable in said axial direction so as to ensure gentle contact. For this purpose the contact surface c is made of elastic material and/or the sensing member is elastically bendable in said axial direction. The elastic material is preferably elastomer, such as rubber, silicon or polyurethane, for instance. The elasticity of the contact surface c also facilitates firm frictional engagement between the rope 3*a*,3*b*,3*c* and the sensing member 31,32,33,34. In this embodiment, displacement of each sensing member 31,32, 33,34 at least in the longitudinal direction of the rope 3*a*,3*b*,3*c* is arranged to trigger said stopping.

So as to provide for the sensing members said displaceability at least in the longitudinal direction of the rope 3*a*,3*b*,3*c*, preferably each of said sensing members 31,32, 33,34 is mounted pivotally displaceably around an axis a, which axis is parallel with the axial direction $X_1$, $X_2$ of the traction member 6. Pivoting displacement of each sensing member 31,32,33,34 is arranged to trigger said stopping i.e. to trigger the drive machinery M to stop the rotation of the traction member 6. In the preferred embodiment, the sensing members 31,32,33,34 are mounted displaceably in the above defined way via a common pivotally displaceable carrier body 35. Thus, the displaceability need not be provided for them individually. Thus, the structure has small amount of moving parts, whereby it is reliable, simple, and easy to manufacture. The carrier body 35 is preferably mounted pivotally on a frame 37 mounted stationary.

In the preferred embodiment, each of said sensing members 31,32,33,34 is mounted pivotally displaceably towards either turning direction around said axis a. Thus, the sensing members 31,32,33,34 can be engaged by the rope 3*a*,3*b*,3*c* and be displaced pushed by the rope at least in the longitudinal direction of the rope 3*a*,3*b*,3*c* independently of the movement direction of the rope.

Figure 8:
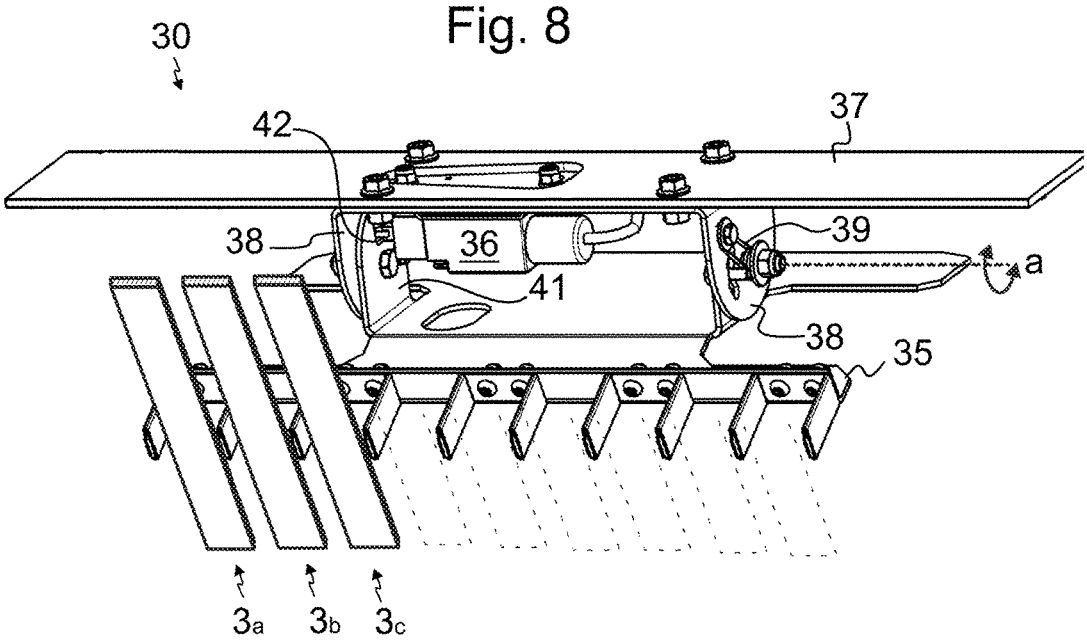
FIG. 8 illustrates the three-dimensionally the means for detecting displacement of the ropes of FIG. 5.

In the preferred embodiment, said means 30 for detecting displacement comprise at least one electrical sensor 36, arranged to sense position of the displaceable carrier body 35. The sensor is preferably in the form of a switch having a sensing nose 40 sensing the position of the carrier body 35. In the preferred embodiment, the sensing nose 40 extends into an opening 42 formed in one of two flanges 41 of the carrier body 35, via which flanges 41 the carrier body 35 is pivotally mounted on a stationary mounted frame 37, in particular on flanges 38 thereof. The means 30 preferably also comprise means 39 for resisting said displacement of the carrier body 35. Said means 30 are in the embodiment illustrated in FIG. 8 in the form of one or more spring 39 arranged to resist pivoting of the carrier body 35. The spring(s) is preferably also used for keeping the sensing members positioned such that the sensing members can pivot towards either direction around axis a. The spring(s) is preferably a helical spring mounted coaxially along the axis a between the carrier body 35 and the frame 37. For achieving the triggering of the drive machinery M to stop the rotation of the rotatable traction member 6 said sensor 36 can either include or be connected to a relay r (as described referring to FIG. 2) operating a safety switch s of the safety circuit 9, for instance.

Figure 9A:
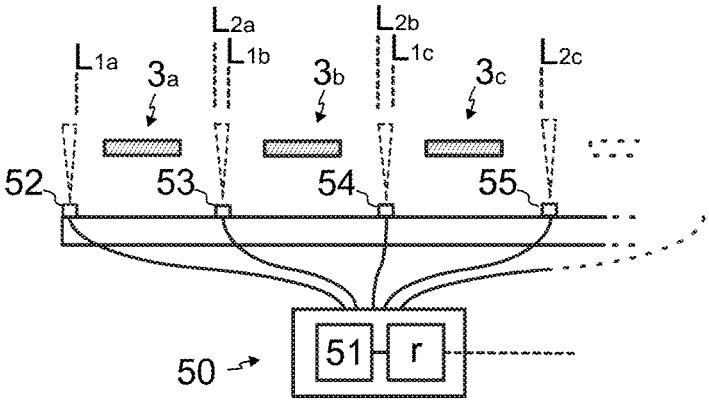
FIG. 9*a* illustrates a third preferred embodiment for the means for detecting displacement of the ropes of the elevator in axial direction of the rotatable traction member.
Figure 9B:
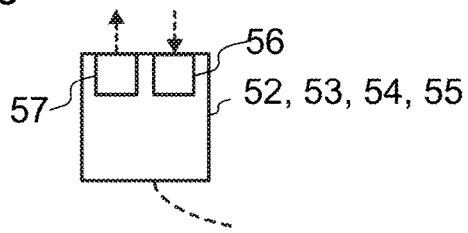
FIG. 9*b* illustrates a preferred structure for a sensing device of FIG. 9*a*.

FIG. 9*a* illustrates a preferred third embodiment for the means 50 for detecting the above mentioned displacement of each of the ropes 3*a*,3*b*,3*c* in axial direction of the rotatable traction member 6. Said means 50 comprise sensing devices 52-55 for receiving electromagnetic radiation or ultrasonic sound from said limit positions L1*a*,L2*a*;L1*b*,L2*b*;L1*c*,L2*c* and a monitoring unit 51, connected to the sensing devices and arranged to trigger said drive machinery M to stop the rotation of the traction member 6 if electromagnetic radiation or ultrasonic sound received from one or more of said limit positions L1*a*,L2*a*;L1*b*,L2*b*;L1*c*,L2*c* meet(s) predetermined criteria, such as reaches a predetermined limit or changes in a predetermined way. Each sensing device 52-55 may be in the form of a photocell, infrared, microwave or laser beam sensor, ultrasonic sound sensor for instance. Said sensing devices 52-55 each comprise a receiver for receiving electromagnetic radiation or ultrasonic sound from a limit position L1*a*,L2*a*;L1*b*,L2*b*;L1*c*,L2*c* it is associated with. FIG. 9*b* illustrates a preferred structure for a sensing device of 52,53,54,55. Preferably, in addition to a receiver 56 each sensing device 52-55 additionally comprises a sender 57 for sending electromagnetic radiation or ultrasonic sound (if the receiver is a receiver for receiving ultrasonic sound) towards the limit position L1*a*,L2*a*;L1*b*,L2*b*;L1*c*,L2*c* it is associated with, whereby the electromagnetic radiation or ultrasonic sound sent by the sender towards the limit position L1*a*, L2*a*;L1*b*,L2*b*;L1*c*,L2*c* is reflected from a rope displaced over the limit position in question. Electromagnetic radiation or ultrasonic sound received by the receiver associated with the limit position L1*a*,L2*a*;L1*b*,L2*b*;L1*c*,L2*c* in question is arranged to be monitored by the monitoring unit 51, and if the electromagnetic radiation or ultrasonic sound received from one or more of said limit positions L1*a*,L2*a*; L1*b*,L2*b*;L1*c*,L2*c* meet(s) predetermined criteria, the monitoring unit 51 is arranged to trigger said drive machinery M to stop the rotation of the traction member 6, e.g. in the elsewhere defined way. For achieving the triggering of the drive machinery M to stop the rotation of the rotatable traction member 6 said monitoring unit is connected to a relay r (as described referring to FIG. 2) operating a safety switch s of the safety circuit 9, for instance. In FIG. 9, the positions whereto the sensing devices 52-55 are arranged to send said electromagnetic radiation or ultrasonic sound, and wherefrom the sensing devices 52-55 are arranged to receive said electromagnetic radiation or ultrasonic sound from are illustrated as beams drawn in dashed line. In case the means 50 are provided without senders, the ambient light conditions and sound conditions provide electromagnetic radiation and ultrasonic sound to such a degree that displacement of the rope over the limit position changes the observation of the receiving device to a detectable amount whereby it is possible to implement the device without a sender.

Alternative to the multiple sensing devices for receiving electromagnetic radiation or ultrasonic sound from said limit positions L1*a*,L2*a*;L1*b*,L2*b*;L1*c*,L2*c* described, said means 50 may comprise only one of said sensing devices for receiving ultrasonic sound or electromagnetic radiation from limit positions L1*a*,L2*a*;L1*b*,L2*b*;L1*c*,L2*c*, i.e. one sensing device for receiving ultrasonic sound or electromagnetic radiation from several limit positions, and a monitoring unit connected to the one sensing device and arranged to trigger said drive machinery M to stop the rotation of the traction member 6 if the ultrasonic sound or electromagnetic radiation received from one or more of said limit positions L1*a*,L2*a*;L1*b*,L2*b*;L1*c*,L2*c* meet(s) predetermined criteria, such as reaches a predetermined limit or changes in a predetermined way. In this case, the one or more sensing devices can be in the form of an ultrasonic sensing device, optical camera, scanner, a machine vision device or a pattern recognition device. In these cases, the sensing device can comprise one or more senders for sending ultrasonic sound or electromagnetic radiation towards said limit positions L1*a*,L2*a*;L1*b*,L2*b*;L1*c*,L2*c*.

The elevator illustrated is an elevator provided with a counterweight; however the elevator may be alternatively configured to be without a counterweight. The means for detecting displacement of the ropes can be adapted to work independent of whether the elevator comprises a counterweight or not. In the above, said triggering is carried out via the safety circuit 9, which is preferable as the safety circuit is a part normally present in any elevator, but this kind of implementation is not necessary, because said triggering could be carried out in many alternative ways.

The ropes 3*a*,3*b*,3*c* next to each other have both a limit position defined for it between them. For each of the ropes 3*a*,3*b*,3*c* two limit positions L1*a*, L2*a*; L1*b*, L2*b*; L1*c*,L2*c* are defined. However, it is possible that for each, rope limit positions in addition to said first and second are defined, and displacement of the rope over this additional limit can trigger an action different from the action described in the above, such as a warning signal in case the additional limit is within the first and second limit positions.

It is to be understood that the above description and the accompanying Figures are only intended to illustrate the present invention. It will be apparent to a person skilled in the art that the inventive concept can be implemented in various ways. The invention and its embodiments are not limited to the examples described above but may vary within the scope of the claims.

The invention claimed is:

1. An elevator comprising an elevator car vertically movable in a hoistway;

a plurality of ropes connected to the elevator car;

a rotatable traction member suspended from a top of the hoistway, the rotatable traction member including a plurality of circumferential traction surface areas, each of the plurality of ropes configured to pass around the rotatable traction member within a corresponding one of the circumferential traction surface areas while having a first end directly connected to the elevator car and a second end directly connected to a counterweight such that the rotatable traction member sustains a weight of the elevator car and the counterweight in the hoistway;

a drive machinery configured to control rotation of the rotatable traction member;

a detector configured to detect displacement of each of the ropes over a first limit position in a first axial direction of the rotatable traction member, and over a second limit position in a second axial direction of the traction member, the detector including sensing members at the first limit position and the second limit position that are pivotally displaceable around an axis parallel with an axis of the rotatable traction member; and a controller configured stop the drive machinery from rotating the rotatable traction member based on the detector detecting the displacement over one or more of the first limit position and the second limit position.

2. The elevator according to claim 1, wherein the first sensing member is at the first limit position, the first sensing member configured to trigger the controller to instruct the drive machinery to stop the rotation of the rotatable traction member in response a respective one of the plurality of ropes colliding into and displacing the first sensing member, and the second sensing member is at the second limit position, the second sensing member configured to trigger the controller to instruct the drive machinery to stop the rotation of the rotatable traction member in response a respective one of the plurality of ropes colliding into and displacing the second sensing member.

3. The elevator according to claim 2, wherein the sensing members are mounted displaceably via a common displaceable carrier body.

4. The elevator according to claim 3, wherein the detector comprises:

at least one electrical sensor configured to sense a position of the displaceable carrier body, and wherein the controller is configured to trigger the controller to instruct the drive machinery to stop the rotation of the traction member, if the position of the displaceable carrier barrier varies pivotably.

5. The elevator according to claim 2, wherein the first sensing member and the second sensing member are displaceable at least in a longitudinal direction of respective ones of the plurality of ropes in response to the respective ones of the plurality of ropes colliding into and displacing a respective one of the first sensing member and the second sensing member in a respective one of the first axial direction and the second axial direction.

6. The elevator according to claim 1, wherein the plurality of ropes are belts.

7. The elevator according to claim 1, wherein the controller is configured to stop the rotation of the rotatable traction member by braking rotation of the rotatable drive member with mechanical brake(s) of the elevator and/or stopping the motor from rotating the rotatable traction member.

8. The elevator according to claim 1, wherein the elevator further comprises:

a safety circuit configured to trip in response to the displacement of one of the plurality of ropes to perform a braking procedure, the braking procedure including one or more of braking rotation of the traction member with at least one mechanical brake of the elevator, and stopping the motor from rotating the rotatable traction member.

9. The elevator according to claim 1, wherein the ropes pass around the rotatable traction member adjacent each other in axial direction of the rotatable traction member as well as in the width-direction of the ropes, the wide sides of the ropes against the traction member.

10. The elevator according to claim 1, wherein the rotatable traction member is a traction wheel.

11. The elevator according to claim 1, wherein each circumferential traction surface area of the rotatable traction member has an individual crowning shape.

12. The elevator according to claim 1, wherein the drive machinery comprises:

a motor configured to rotate the rotatable traction member.

13. An elevator comprising:

an elevator car vertically movable in a hoistway;

a plurality of ropes connected to the elevator car;

a rotatable traction member including a plurality of circumferential traction surface areas, each of the plurality of ropes configured to pass around the rotatable traction member within a corresponding one of the circumferential traction surface areas;

a drive machinery configured to control rotation of the rotatable traction member;

a detector configured to detect displacement of each of the ropes over a first limit position in a first axial direction of the rotatable traction member, and over a second limit position in a second axial direction of the traction member, the detector including sensing members positioned at the first limit position and the second limit position and mounted pivotally displaceable around an axis parallel with the first axial direction and the second axial direction of the traction member; and a controller configured stop the drive machinery from rotating the rotatable traction member based on the detector detecting, via pivotal displacement of one or more of the sensing members, the displacement of one of the plurality of ropes over one or more of the first limit position and the second limit position.

* * * * *